US007441766B2

(12) United States Patent
Seki et al.

(10) Patent No.: US 7,441,766 B2
(45) Date of Patent: Oct. 28, 2008

(54) PAPER FEEDER WITH SEPARATION PAD AND VIBRATION BUFFERS

(75) Inventors: Hiroyuki Seki, Tokai (JP); Shunichi Oohara, Ushiku (JP); Yoshiaki Yamauchi, Minori (JP); Takamitsu Ikematsu, Tokai (JP); Kazuo Kikuchi, Hitachi (JP); Seiji Okunomiya, Hitachinaka (JP)

(73) Assignee: Ricoh Printing Systems, Ltd., Tokyo (JP)

( * ) Notice: Subject to any disclaimer, the term of this patent is extended or adjusted under 35 U.S.C. 154(b) by 373 days.

(21) Appl. No.: 10/902,048

(22) Filed: Jul. 30, 2004

(65) Prior Publication Data

US 2005/0067758 A1 Mar. 31, 2005

(30) Foreign Application Priority Data

Aug. 27, 2003 (JP) ..... 2003-302263

(51) Int. Cl.
*B65H 3/52* (2006.01)

(52) U.S. Cl. ..... 271/121; 271/167

(58) Field of Classification Search ..... 271/121, 271/124, 104, 137, 167
See application file for complete search history.

(56) References Cited

U.S. PATENT DOCUMENTS 4,995,601 A * 2/1991 Ohashi et al. ..... 271/127
5,528,352 A * 6/1996 Ichinokawa et al. ..... 399/365
6,318,716 B1 * 11/2001 Okuda ..... 271/121
7,128,095 B2 * 10/2006 Hayashi ..... 138/30

FOREIGN PATENT DOCUMENTS

| | | | |
|---|---|---|---|
| JP | 05-026294 | | 2/1993 |
| JP | 05-118381 | | 5/1993 |
| JP | 09-249321 | | 9/1997 |
| JP | 2000-191165 | | 7/2000 |
| JP | 2003212373 A | * | 7/2003 |
| JP | 2004251291 A | * | 9/2004 |

OTHER PUBLICATIONS

Japanese Patent Office Action, dated Sep. 7, 2007, in corresponding Japanese Patent Application No. 2003-302263.

* cited by examiner

*Primary Examiner*—Patrick Mackey
*Assistant Examiner*—Gerald W McClain
(74) *Attorney, Agent, or Firm*—Antonelli, Terry, Stout & Kraus, LLP.

(57) ABSTRACT

A paper feeder is capable of minimizing abnormal noise produced at a separation pad during paper feed, without reducing the paper feed capability, for use in an image forming apparatus using the same. Buffers are mounted on the separation pad. This arrangement ensures that, when a stick-slip condition occurs between the paper and separation pad during paper feed, and the separation pad is vibrated by the paper, the buffer vibrates so as to dissipate the vibration energy of the separation pad, with the result that the vibration of the separation pad is minimized, thereby to reduce any abnormal noise.

9 Claims, 12 Drawing Sheets

PAPER FEEDER WITH SEPARATION PAD AND VIBRATION BUFFERS

BACKGROUND OF THE INVENTION

The present invention relates to a paper feeder for feeding sheets of paper by separating them one by one, by means of a paper feed roller and a separation pad pressed thereto, and, more particularly, to an image forming apparatus equipped therewith.

An apparatus for feeding paper in a printer and a copying machine typically is provided with a device to separate each of the sheets of paper loaded on a paper cassette or a manual feed tray and to feed them into the apparatus. FIG. 8 shows an example of such a paper feeder. As shown in FIG. 8, the leading edge of paper 16 is pressed against a paper feed roller 200 by a separation pad 201. Sheets of paper 16 are fed, after being separated from one another, using the difference among the friction coefficient $\mu_{PM}$ of the separation pad 201 with respect to the paper 16, the friction coefficient $\mu_{MM}$ between the sheets of paper 16, and the friction coefficient $\mu_{RM}$ on the outer peripheral surface of the paper feed roller 200 with respect to the paper 16. To put it another way, using a paper feed roller 200 and a separation pad 201, where $\mu_{RM}>\mu_{PM}>\mu_{MM}$, when the paper feed roller 200 is rotated to feed the paper 16, sheets of paper 16 are separated and are fed.

To ensure smooth feed of the paper 16 in the direction of paper feed, the surface of the separation pad 201 must be pressed against the outer peripheral surface of the paper feed roller 200 with a uniform pressure. If it is pressed with an uneven pressure, the paper may be fed in a slanting direction close to the separation pad, and a paper jam may occur.

To press the surface of the separation pad 201 against the outer peripheral surface of the paper feed roller 200 with a uniform pressure, the separation pad 201 is put in a position in which it is freely rotatable about the shaft 204 provided on the separation holder 202, so that the separation pad 201 is located vertical to the tangential force L of the outer peripheral surface of the paper feed roller 200 and parallel to the feed direction of the paper 16, as shown in FIG. 9, for example. More specifically, a U-shaped groove 203 is provided on a flange extending from the bottom of the separation pad 201, and the separation pad 201 is mounted by way of this flange on the outer peripheral surface of the shaft 204. The size of the groove 203 is greater than the outer diameter of the shaft 204 to ensure that the separation pad 201 can be rotated smoothly in conformity with the profile of the outer peripheral surface of the paper feed roller 200 or the surface profile of the paper 16.

In this connection, the friction coefficient $\mu_{RM}$ on the outer peripheral surface of the paper feed roller 200 with respect to the paper 16 is different from the friction coefficient $\mu_{PM}$ on the surface of the separation pad 201, as described above. Since the size of the U-shaped groove 203 is greater than the outer diameter of the shaft 204, as described above, there is a slight play between the separation pad 201 and the separation holder 202. Thus, when paper 16 is fed between the separation pad 201 and the paper feed roller 200, the paper 16 rubs against the separation pad 201 and a stick-slip condition occurs. Noise may be caused by the vibration produced at this time. This problem is likely to occur especially when there is a greater surface friction coefficient, as in the case of an OHP (overhead transparent film), or when there is a great displacement volume between the separation pad 201 and the paper feed roller 200, as in the case of cardboard, accompanied with an increase in the pressure of the separation pad 201 and in the friction force between the separation pad 201 and the paper 16. Further, a stick-slip condition is more likely to take place with an increasing feed rate of the paper 16 by the paper feed roller 200, with the result that abnormal noise will be produced.

To prevent abnormal noise from occurring at the time of paper feed, the following technique is proposed:

(1) Modify the weight and shape of the separation pad 201 and the separation holder 202 to shift the resonant frequency between the separation pad 201 and the separation holder 202.

(2) Reduce the pressure of the separation pad 201 that is applied to the paper feed roller 200, thereby minimizing the possibility of a stick-slip condition being generated.

(3) Press the separation pad 201 against another member, for example, the frame of the printer, with the paper feeder mounted thereon, thereby reducing the vibration of the separation holder 202 (e.g. see Japanese Application Patent Laid-open Publication No. 2000-191165 (pages 3 and 4, FIGS. 1 and 3)).

However, the method (1) is incapable of meeting the frequency of the abnormal noise caused by differences in the thickness or material quality of the paper 16. Abnormal noise may occur, depending on the type of paper 16.

The method (2) causes the separation capability of the paper 16 to deteriorate, with the result that a plurality of sheets of paper 16 may be fed at one time.

The method (3) fails to reduce the vibration of the separation pad 201. The frame is hit by the separation holder 202 through the vibration transmitted from the separation pad 201, and abnormal noise is produced as a result. Alternatively, it is also possible that the frame, or another portion in contact with the frame, is vibrated by the vibration transmitted from the separation pad 201, and abnormal noise is generated. Further, a failure other than abnormal noise occurs in the following case: When an apparatus equipped with this paper feeder is a laser printer, the printed image may be disturbed if vibration is transmitted to the optical unit of the apparatus.

SUMMARY OF THE INVENTION

In view of the problems described above, it is an object of the present invention to provide a paper feeder that is capable of minimizing the generation of abnormal noise resulting from stick-slip of the paper and separation pad, without reducing the paper feed capability.

To achieve this object, the paper feeder of the present invention operates to feed sheets of paper, by separating them one by one, and includes:

a paper feed roller for feeding paper;

a separation pad holder for supporting a separation pad rotatably and for applying the separation pad to the paper feed roller; and a holder support for supporting the separation pad holder rotatably;

wherein this paper feeder feeds the sheets of paper by separating them one by one between the paper feed roller and the separation pad. This paper feeder is further characterized in that the separation pad is provided with one or more vibration buffers each consisting of a viscoelastic body.

The vibration buffer is a cantilever beam having one end fixed to the separation pad and the other end designed as a free end. It is preferred that the vibration buffers be mounted as a pair extending in one direction of the separation pad and in a direction symmetrical thereto. Here the value obtained by dividing the logarithmic decrement of the vibration buffer by the primary resonant frequency of the vibration buffer is equal to or greater than $2.0\times10^{-2}$ (1/Hz).

The vibration buffer is also preferably cylindrical in shape. It is preferred that the viscoelastic body of the vibration buffer be made of a material having a high degree of attenuation, such as a rubber or a member with its spring surface coated with viscoelastic material.

Even if a stick-slip condition has occurred between the paper and the separation pad at the time of paper feed, the vibration buffer mounted on the separation pad in accordance with the present invention dissipates the vibration energy of the separation pad, thereby avoiding vibration of the separation pad.

DESCRIPTION OF THE EMBODIMENTS

Figure 7:
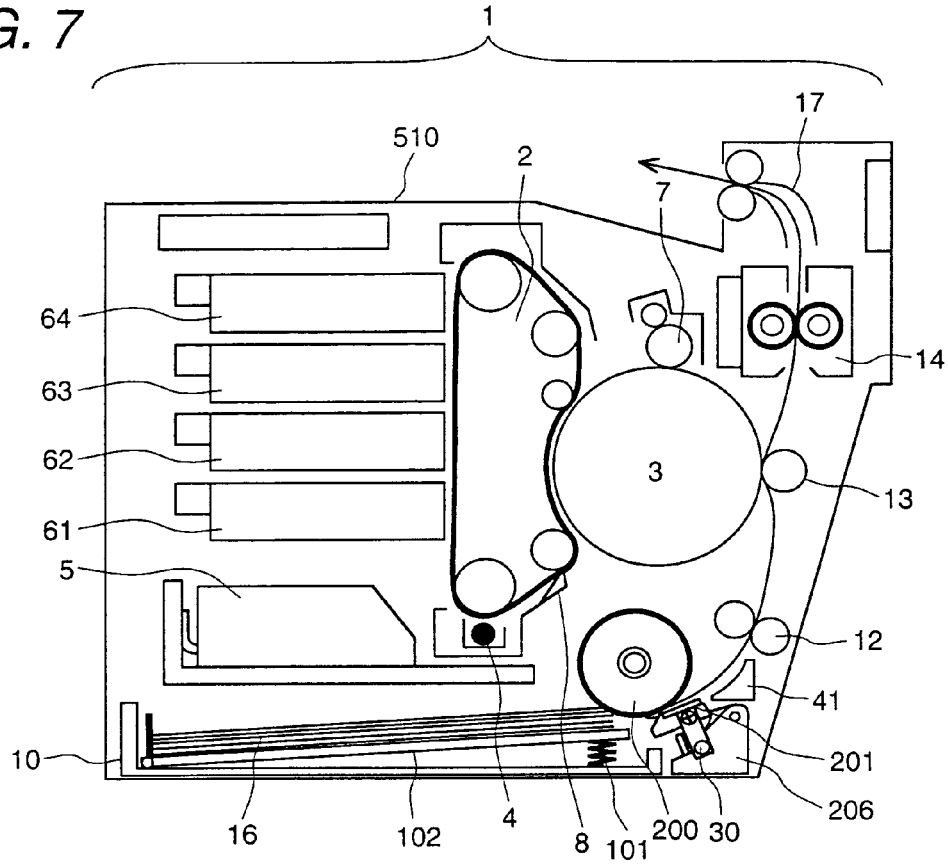
FIG. 7 is a diagrammatic front view representing a printer loaded with first through third embodiments of a paper feeder according to the present invention.
Figure 8:
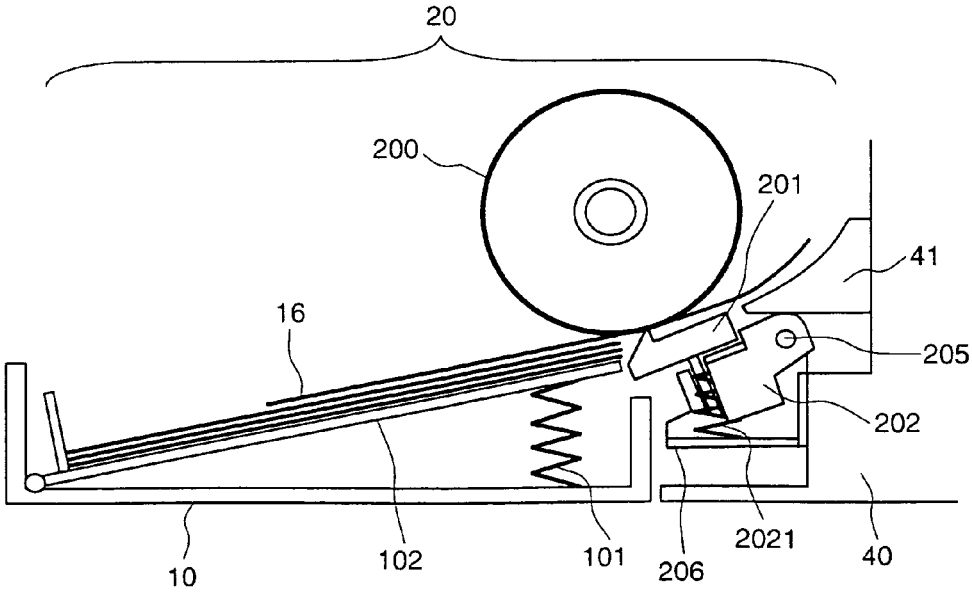
FIG. 8 is a diagrammatic sectional view showing a known paper feeder.
Figure 9:
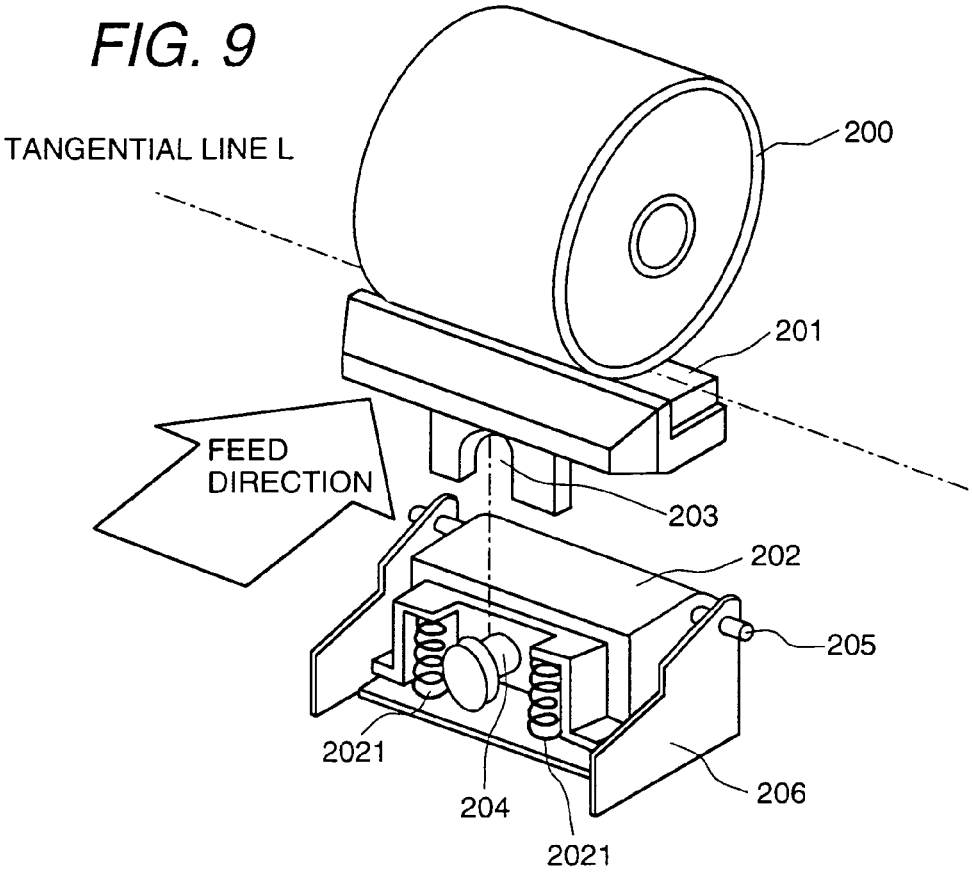
FIG. 9 is a perspective view showing a known paper feeder.

Referring to FIG. 7, an example of a printer (image forming apparatus) with the paper feeder of the present invention mounted thereon will be described.

A printing signal is sent to a printer 1 from an information processing apparatus (e.g. computer). Based on the print signal sent thereto, an exposure apparatus 5 applies laser light to a photoconductor belt 2 that has been uniformly charged by a charging device 4, and an electrostatic latent image is formed thereon.

More specifically, an electrostatic latent image corresponding to a black toner image is formed on the photoconductor belt 2 by the exposure apparatus 5, and this image is turned into a toner image through development by a black developing device 64. The apparatus includes a developing device 61 using cyan toner, a developing device 62 using magenta toner, a developing device 63 using yellow toner, and a developing device 64 using black toner. The developing functions of the developing devices 61, 62, 63 and 64 can be turned on or off by controlling the bias voltage supplied thereto. The toner image formed on the photoconductor belt 2 is transferred onto the surface of the intermediate transfer unit 3 at the portion in contact with the intermediate transfer unit 3. In the meantime, the toner remaining after toner transfer, i.e. the toner that has not been transferred on the photoconductor belt 2, is removed by a blade 8. After that, the electric charge remaining on the surface of the photoconductor belt 2 is removed by an Erase lamp (not illustrated).

After the operation of returning the surface of the photoconductor belt 2 to the initial state has been completed, a cyan toner image, representing the next color image, is formed on the surface of the photoconductor belt 2 in a similar manner, and it is transferred to the intermediate transfer unit 3 and held there. The same process is repeated for magenta and yellow. Four-color toner images are superimposed on the intermediate transfer unit 3 and are held on the surface thereof.

After the four-color toner image has been formed on the surface of the intermediate transfer unit 3, it is transferred onto the paper 16 by a transfer roller 13. Thus, the paper feed roller 200 of the paper feeder 20 is rotated and sheets of paper 16 stored in a paper cassette 10 are picked up. The individual sheets of paper are fed out to the transfer roller after having been separated one by one. The paper cassette 10 is mounted removably below the photoconductor belt 2 and the exposure apparatus 5. An intermediate plate 102 for stacking sheets of paper 16 is installed inside the paper cassette 10. One end of the intermediate plate 102 is pushed upward by a coil spring 101.

Paper 16 that has been fed out by the paper feed roller 200 is fed to a resist roller 12, where any oblique feed of the paper 16 is corrected. The paper feed roller 200 is then stopped.

Then, rotation of the resist roller 12 starts at intervals timed with the position of the toner image on the intermediate transfer unit 3. At intervals timed with the leading edge of the paper 16 contacting the intermediate transfer unit 3, the transfer roller 13 is pressed against the back surface of the paper 16 and the toner image on the surface of the intermediate transfer unit 3 is electrostatically transferred onto the paper 16.

The paper 16 with the toner image transferred thereon passes between the heating roller and pressure roller of a fixing device 14. The image is fixed on the paper 16, is guided to an ejector guide 17, and is stacked on the upper surface 510 of the printer 1.

[Embodiment 1]

Figure 1:
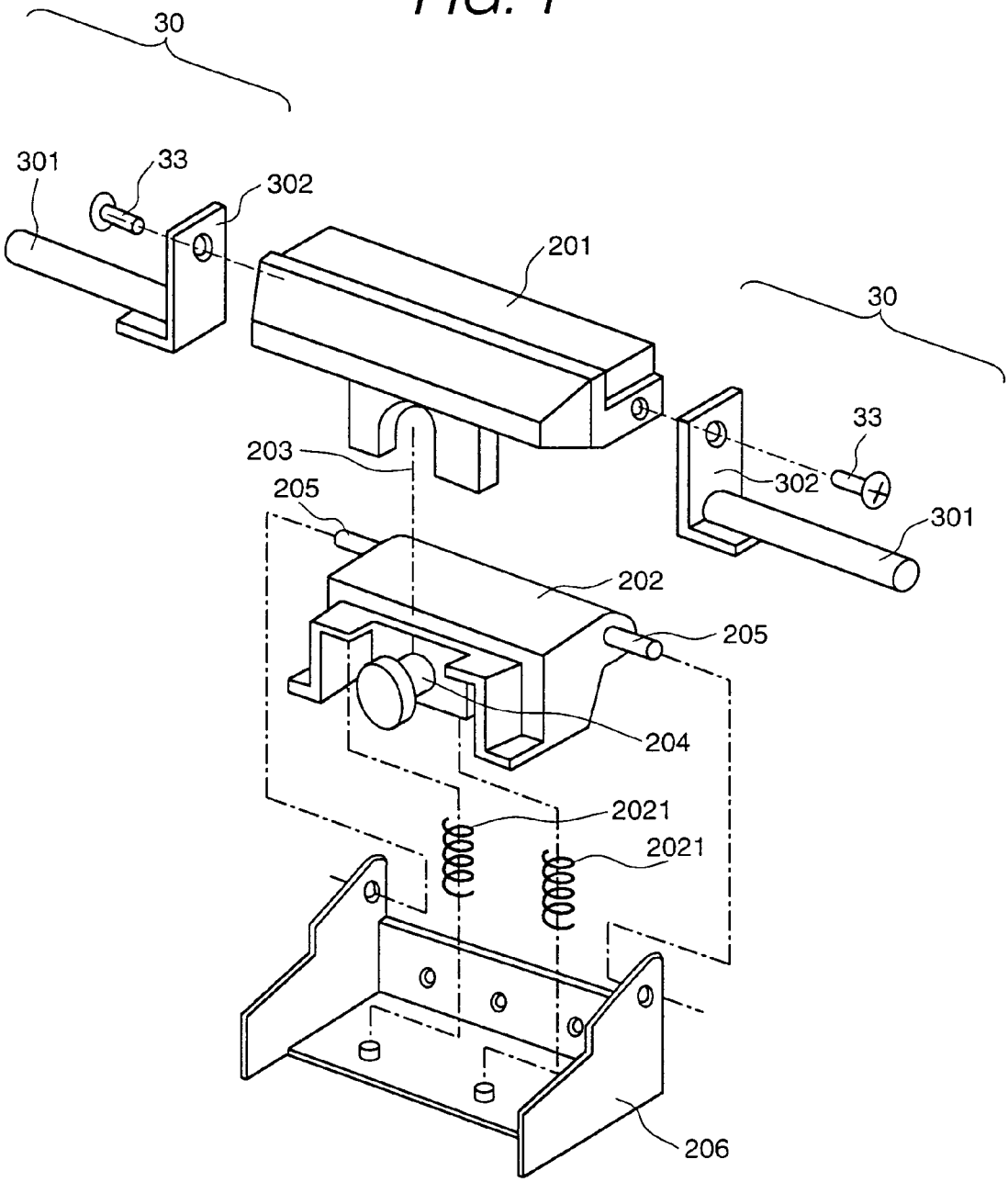
FIG. 1 is a developed perspective view representing the configuration of first through third embodiments of a paper feeder according to the present invention.
Figure 2:
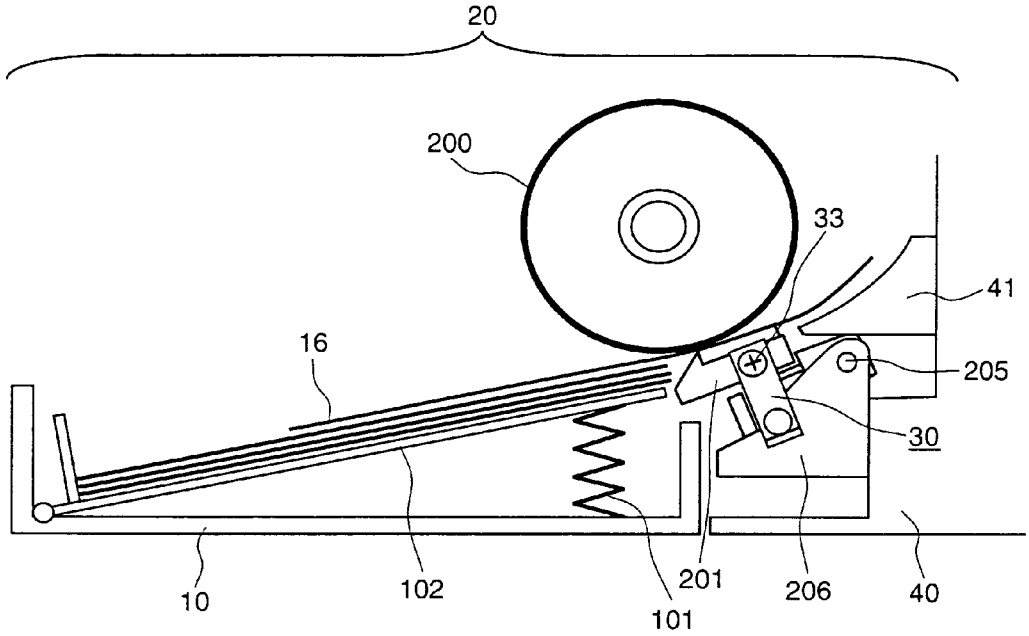
FIG. 2 is a diagrammatic side view representing the configuration of first through third and fifth embodiments of a paper feeder according to the present invention.
Figure 3:
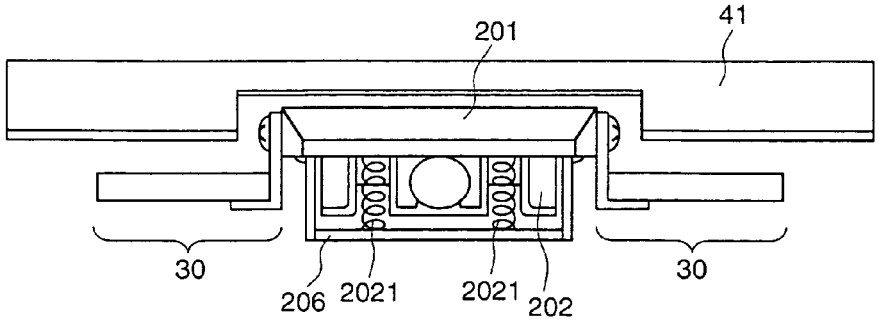
FIG. 3 is a diagrammatic front view representing the configuration of first through third embodiments of a paper feeder according to the present invention.

A first embodiment of a paper feeder of the present invention will be described with reference to the drawings:

FIG. 1 is a developed perspective view representing the configuration a paper feeder according to the present invention. FIG. 2 is a diagram representing the configuration of a paper feeder according to the present invention as observed from the side of the printer 1. FIG. 3 is a plan view representing the configuration of a paper feeder according to the present invention as observed from the front of the printer 1.

The shaft 204 of the separation holder 202 is inserted into the groove 203 in such a manner that the separation pad 201 is supported rotatably about the shaft 204.

The separation holder 202 is provided with a rotary shaft 205. The rotary shaft is supported by the holder support 206 to permit free rotation of the separation holder 202 about the rotary shaft 205. A pair of coil springs 2021 is installed between the holder support 206 and the separation holder 202. The coil springs 2021 raise the separation holder 202 about the rotary shaft 205 in the direction of the paper feed roller 200 so that the separation pad 201 is pressed against the paper feed roller 200. The holder support 206 is secured on the frame 40 of the printer 1.

Buffers 30 are secured on both ends of the separation pad 201 by means of screws. As shown in FIGS. 2 and 3, they are fixed on both sides of the separation pad 201 so as to extend in a direction perpendicular to the paper feed direction to ensure that the buffer 30 will enter the space surrounded by the paper cassette 10, paper feed guide 41 and frame 40. To put it another way, the buffer 30 is located below the surface contacted by the separation pad 201 and paper 16, and below the guide surface of the paper feed guide 41; therefore, the feed of the paper 16 is not interrupted.

Figure 4A:
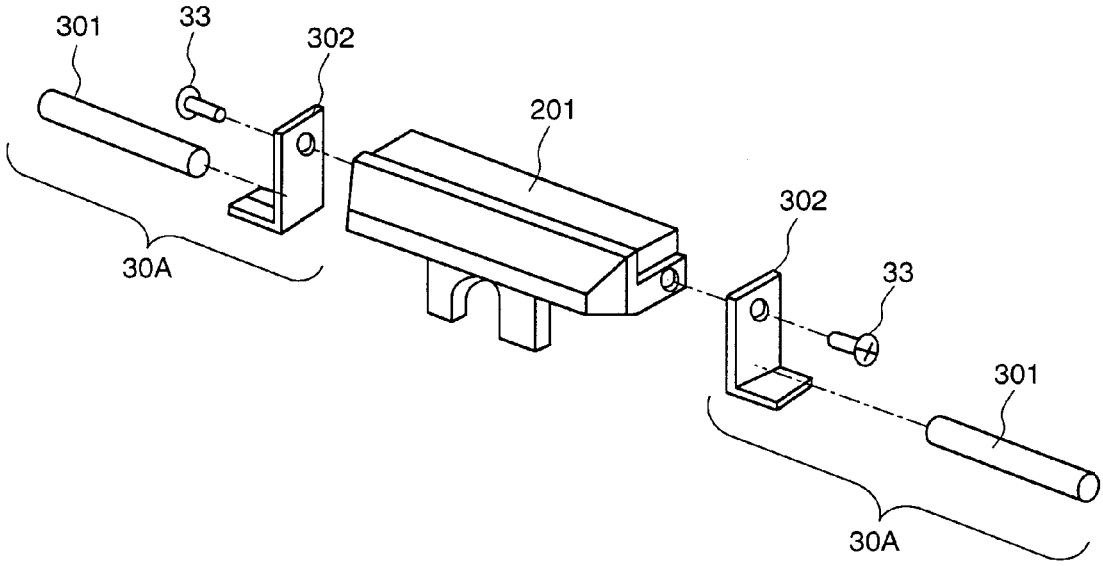
FIGS. 4(*a*) and 4(*b*) show a separation pad and a buffer for use in a first embodiment of a paper feeder according to the present invention, wherein FIG. 4(*a*) is a developed perspective view showing the device before assembling and FIG. 4(*b*) a perspective view showing the device after assembling.
Figure 4B:
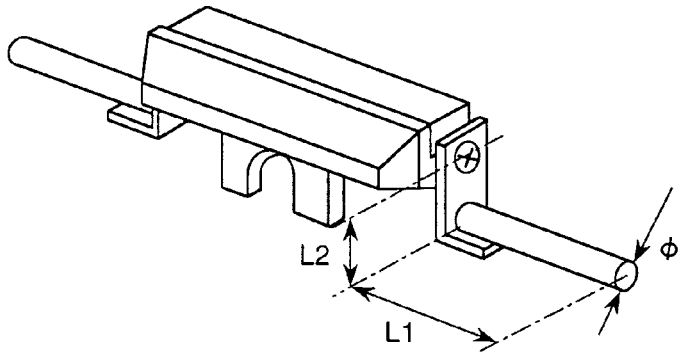

FIGS. 4(*a*) and 4(*b*) are perspective views showing the buffer of the first embodiment in a paper feeder according to the present invention. The buffer 30A consists of a fixture 302 and a viscoelastic body 301. The one side of the viscoelastic body 301 is fixed to the fixture 302 by adhesion or the like, and the other end is free; namely, the viscoelastic body 301 is designed in the form of a cantilever beam structure. The preferred characteristics of the buffers 30 (including buffers 30A through 30D) will be described below.

Figure 13:
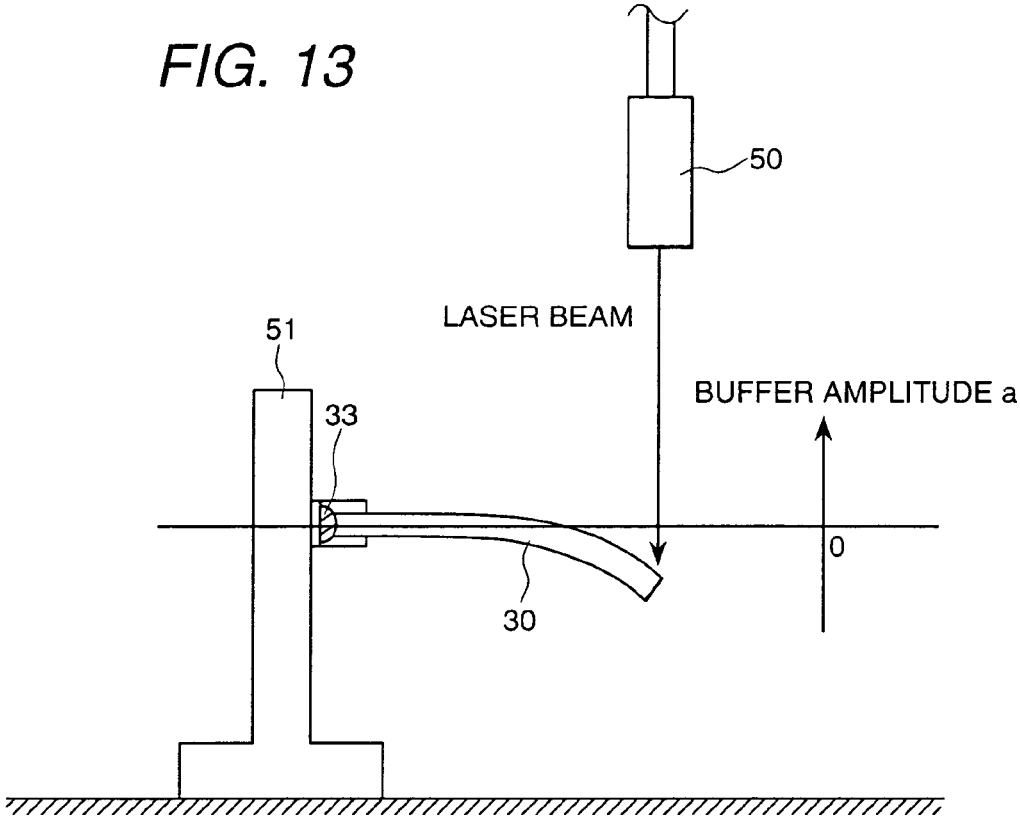
FIG. 13 is a diagram showing an example of an apparatus for measuring the vibration characteristics of a buffer 30 in a paper feeder of the present invention.

FIG. 13 is a diagram showing an example of an apparatus for measuring the characteristics of the buffer 30. In the first place, the buffer 30 is secured onto a stationary base 51. A displacement gauge—for example, a non-contact laser displacement gauge 50—is installed so that laser light will be directed at the free end of the buffer 30. In this case, in order to ensure that the laser displacement gauge 50 can measure the amplitude in the direction the buffer vibrates when the separation pad is subjected to a stick-slip condition during paper feed, an adjustment is made in the direction of fixing the buffer 30 and the laser displacement gauge 50. After that, the buffer 30 is made to vibrate by applying a force only once in the direction that the buffer is vibrated when a stick-slip condition occurs to the separation pad, namely, in the upward or downward direction as seen in FIG. 13. At this time, the laser light is used to measure the amplitude on the free end "a" of the viscoelastic body 301 of the buffer 30 as it vibrates.

Figure 14:
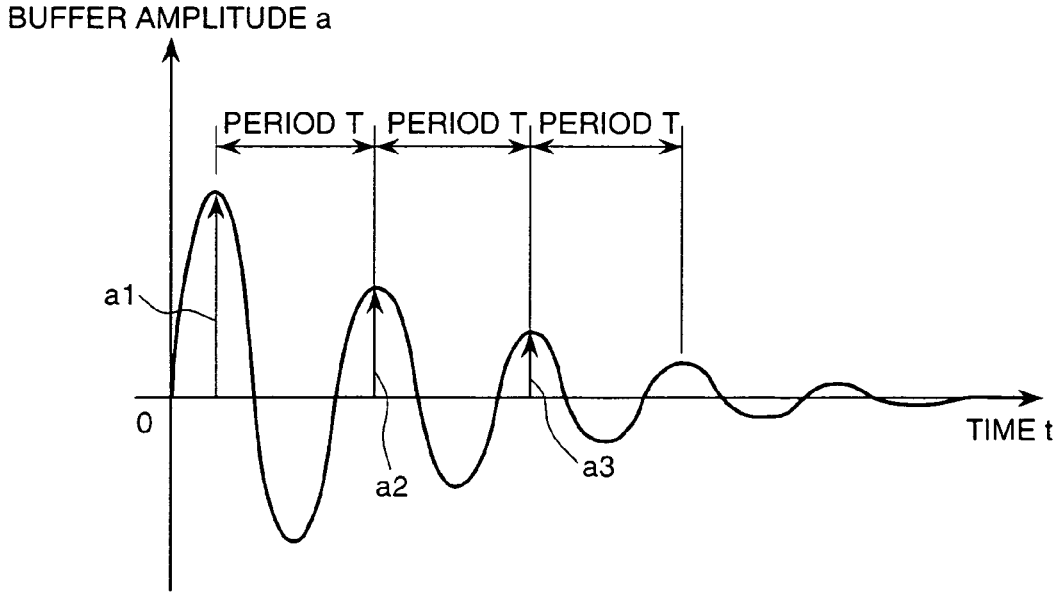
FIG. 14 is a graph showing an example of vibration characteristics of a buffer 30 in a paper feeder of the present invention.

FIG. 14 shows an example of the result of measuring the amplitude of the vibration of the buffer 30 by means of the measuring instrument of FIG. 13. The buffer 30 stops after undergoing viscous damping and free vibration. The amplitude is assumed to be 0 at the position where the buffer 30 has stopped. The maximum values of the amplitude of the same phase at this time, for example, the amplitude on the positive side shown in FIG. 14, are assumed to be "a1, a2, a3, . . . " in the ascending order of measuring time "t", and the cycle of the amplitude is assumed to be "T" (unit: s).

A series "$a_m$" (where "m" denotes 1, 2, . . . ) consisting of the maximum values of amplitudes of the same phase in the reducing vibration constitutes a geometric series that is reduced at the same ratio at every cycle. The "1 n ($a_m/a_{m+1}$), as a natural logarithm of this ratio, is assumed to be a logarithmic decrement δ. Further, the primary resonant frequency of the buffer 30 is assumed to be F=1/T (unit: Hz).

Figure 15:
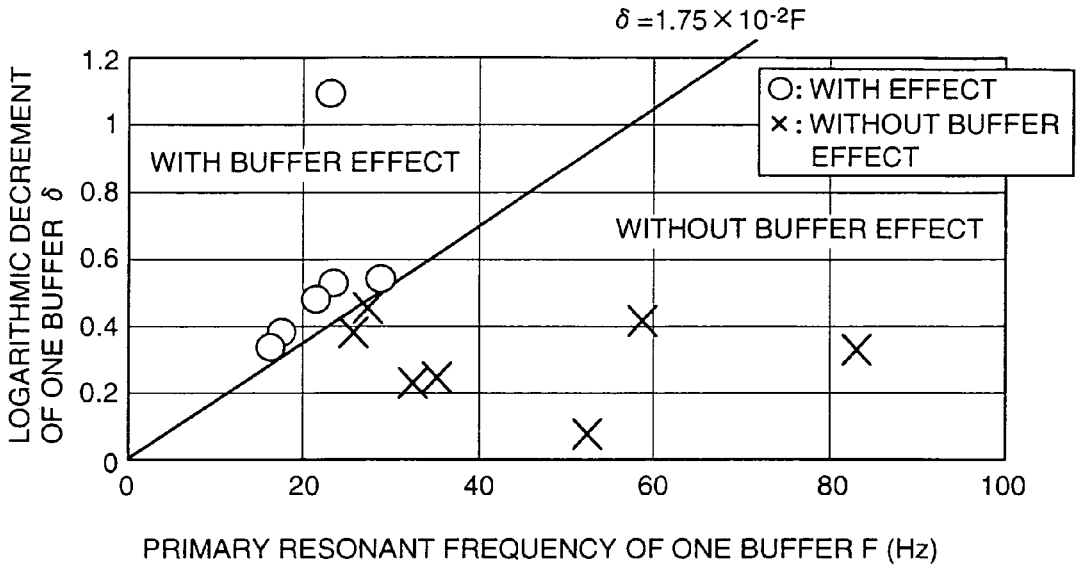
FIG. 15 is a graph showing an example of the relationship between the primary resonant frequency F and logarithmic decrement δ of the buffers 30A through 30D, and the effect of preventing abnormal noise when the buffers 30A through 30D are mounted on both ends of the separation pad 201 in first through fourth embodiments of the paper feeder of the present invention.

FIG. 15 shows an example of the relationship between the primary resonant frequency F and logarithmic decrement δ of the buffers 30, and it shows the effect of preventing abnormal noise when the buffers 30 are mounted on both ends of the separation pad 201 in accordance with the present invention. In FIG. 15, a circle ("o") indicates that no abnormal noise has occurred during paper feed, whereas a cross "x" denotes that abnormal noise has occurred during paper feed. As a result, in the paper feeder 20 of the present invention, the viscoelastic body 301 and fixture 302 are selected in such a way that the primary resonant frequency F and logarithmic decrement δ of the buffers 30 meets the relationship $\delta/F \geqq 1.75\times10^{-2}$ (unit: 1 Hz). The buffer 30A based thereon is mounted on each end of the separation pad 201 in a symmetrical form, thereby preventing generation of abnormal noise caused by the stick-slip condition between the paper 16 and separation pad 201.

The viscoelastic body 301 is a cylindrical body of CR rubber and the one end is bonded to the fixture 302. In this case, the viscoelastic body 301 is formed of a CR rubber. This viscoelastic body 301 is preferably a cylindrical body having a rubber hardness of 50 through 60, a diameter of 4 through 6 and a length L1 of 40 through 60 mm. The fixture 302 is preferably made of a steel plate having a thickness t of 0.2 through 0.6 mm, and a height to the center of the tapped hole L2 of 14 through 16 mm. These materials make it possible to create a buffer 30A meeting the requirements of the relationship $\delta/F \geqq 1.75\times10^{-2}$.

The fixture 302 is engaged with tapped holes on both ends of the separation pad 201. The fixture 302 of the buffer 30A can be fixed on each end of the separation pad 201 by a screw 33. The paper feed roller 200 rotates. When the paper 16 sandwiched by the paper feed roller 200 and the separation pad 201 is fed, a stick-slip condition may occur between the paper 16 and the separation pad 201, and the separation pad 201 is vibrated by the paper 16. In this case, the CR rubber serving as the viscoelastic body 301 of the buffer 30A, which is secured on the separation pad 201, vibrates with the result that the vibration energy of the separation pad 201 is dissipated. Thus, the acceleration of the vibration of the separation pad 201 is kept at 0.2 $m/s^2$ or less, without exceeding 10 $m/s^2$ at a frequency of about 400 through 460 Hz that causes an abnormal noise, thereby preventing abnormal noise from being generated in the present embodiment.

[Embodiment 2]

Figure 5A:
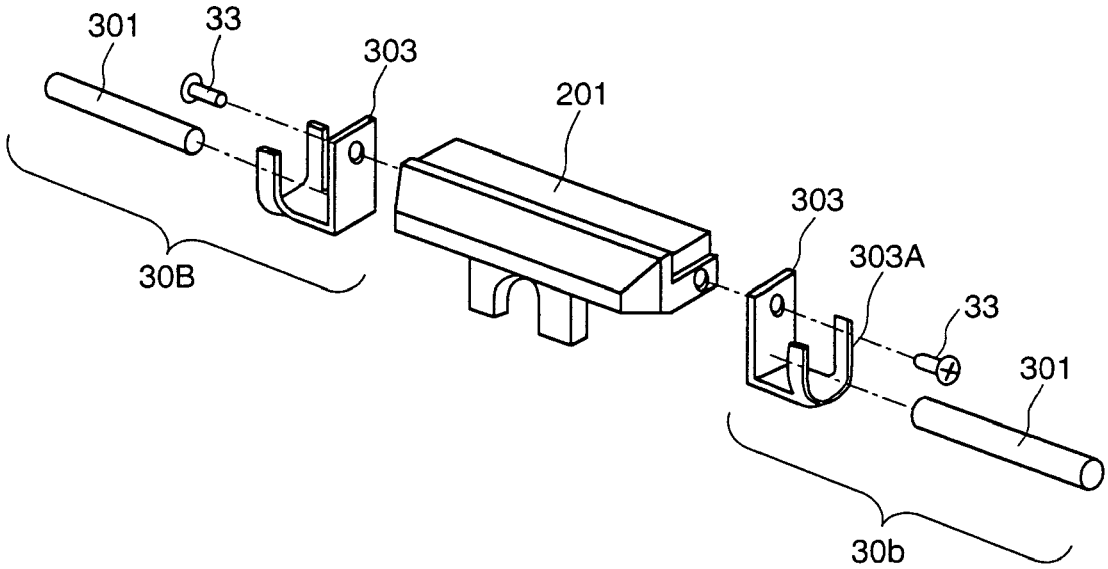
FIGS. 5(*a*) and 5(*b*) show a separation pad and a buffer for use in a second embodiment of a paper feeder according to the present invention, wherein FIG. 5(*a*) is a developed perspective view showing the device before assembling and FIG. 5(*b*) a perspective view showing the device after assembling.
Figure 5B:
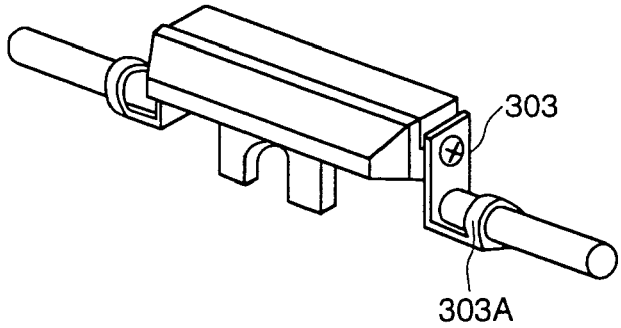

FIGS. 5(*a*) and 5(*b*) show the buffer 30B in a second embodiment of a paper feeder according to the present invention.

The configuration of this second embodiment of a paper feeder according to the present invention is approximately the same as that of the first embodiment, except for the portion of the buffer 30, and therefore, details of the common elements will not be described.

The difference between the buffer 30B and the buffer 30A of the first embodiment is that a crimping portion 303A is provided for securing one end of the viscoelastic body 301 to the fixture 303. The other end is a free end without being secured to any place. In this case, the viscoelastic body 301 and fixture 303 are selected in such a way that the buffers 30B will meet the requirement of the primary resonant frequency F and logarithmic decrement δ, as in the case of the first embodiment of the present invention. The buffer 30B based thereon is mounted on each side of the separation pad 201 in a symmetrical form, whereby the stick-slip condition between the paper 16 and separation pad 201 can be avoided. The viscoelastic body 301 in the present embodiment is a CR rubber member of cylindrical form, and one end is crimped for installation on the crimped portion 303A of the fixture 303. The fixture 303 is engaged with a tapped hole on each side of the separation pad 201. The fixture 303 of the buffer 30B is mounted by a screw 33 on each end of the separation pad 201.

When the paper feed roller 200 rotates and the paper 16 sandwiched by the paper feed roller 200 and separation pad 201 is fed, a stick-slip condition may occur between the paper 16 and the separation pad 201, and the separation pad 201 is vibrated by the paper 16. The CR rubber serving as a viscoelastic body 301 of the buffer 30B fixed on the separation pad 201 vibrates to dissipate the vibration energy of the separation pad 201. As a result, the vibration of the separation pad 201 is minimized, thereby to reduce the abnormal noise.

[Embodiment 3]

Figure 6A:
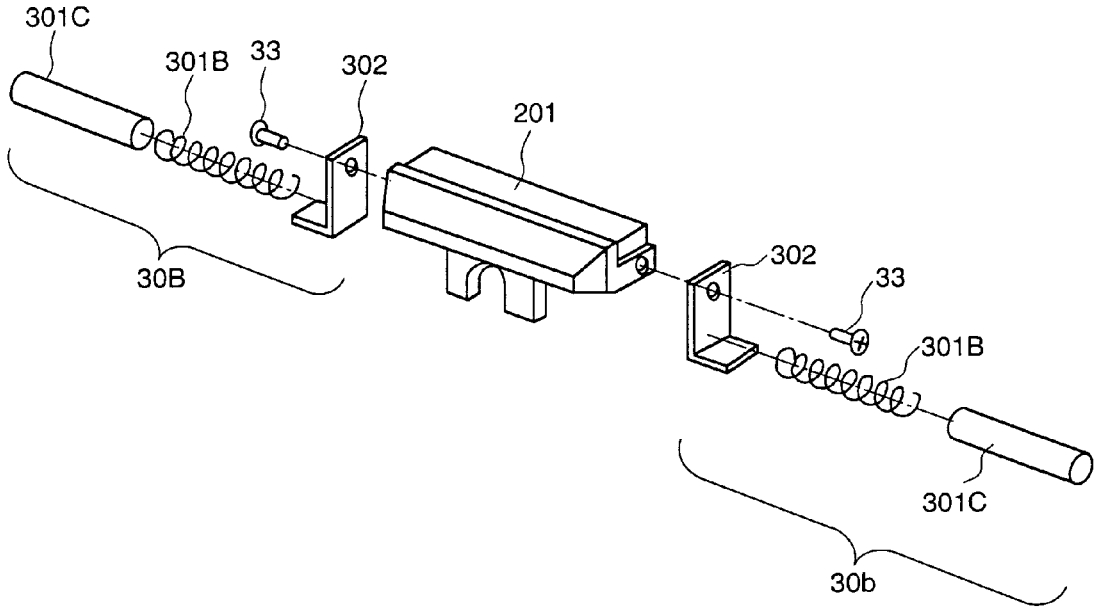
FIGS. 6(*a*) and 6(*b*) show a separation pad and a buffer for use in a third embodiment of a paper feeder according to the present invention, wherein FIG. 6(*a*) is a perspective view showing the device before assembling and FIG. 6(*b*) a perspective view showing the device after assembling.
Figure 6B:
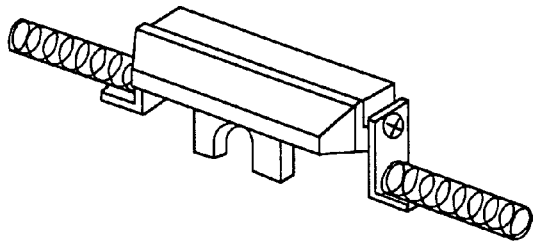

FIGS. 6(*a*) and 6(*b*) show a buffer 30C in a third embodiment of a paper feeder according to the present invention. The difference between the configuration of the third embodiment of the present invention and the first embodiment is found in the buffer.

The buffer 30C of the present embodiment differs from the buffer 30A of the first embodiment in that a coil spring 301B is used in the viscoelastic body 301 supporting the separation pad 201, and the surface is coated with a silicone rubber 301C. It is installed in the form of a cantilever beam as in the case of the previous embodiment.

Similar to the case of the first embodiment of the present invention, the buffer 30C is configured to ensure that the primary resonant frequency F and logarithmic decrement δ of the buffers 30 meets the requirement of the relationship $\delta/F \geqq 1.75\times10^{-2}$ (unit: 1 Hz). This buffer 30C is mounted on each end of the separation pad 201 in a symmetrical form so that a stick-slip condition between the paper 16 and separation pad 201 can be avoided. The surface of the coil spring 301B is coated with silicone rubber 301C, whereby the damping factor of the coil spring 301B can be increased.

The paper 16 sandwiched by the paper feed roller 200 and separation pad 201 is fed by the rotation of the paper feed roller 200. In this case, a stick-slip condition between the paper 16 and the separation pad 201 causes the separation pad 201 to be vibrated by the paper 16. In this case, a vibration is applied to the coil spring 301B of the buffer 30C that is fixed on the separation pad 201 and is coated with silicone rubber 301C, thereby to dissipate the vibration energy of the separation pad 201. As a result, the vibration of the separation pad 201 is minimized to reduce the abnormal noise.

[Embodiment 4]

Figure 11:
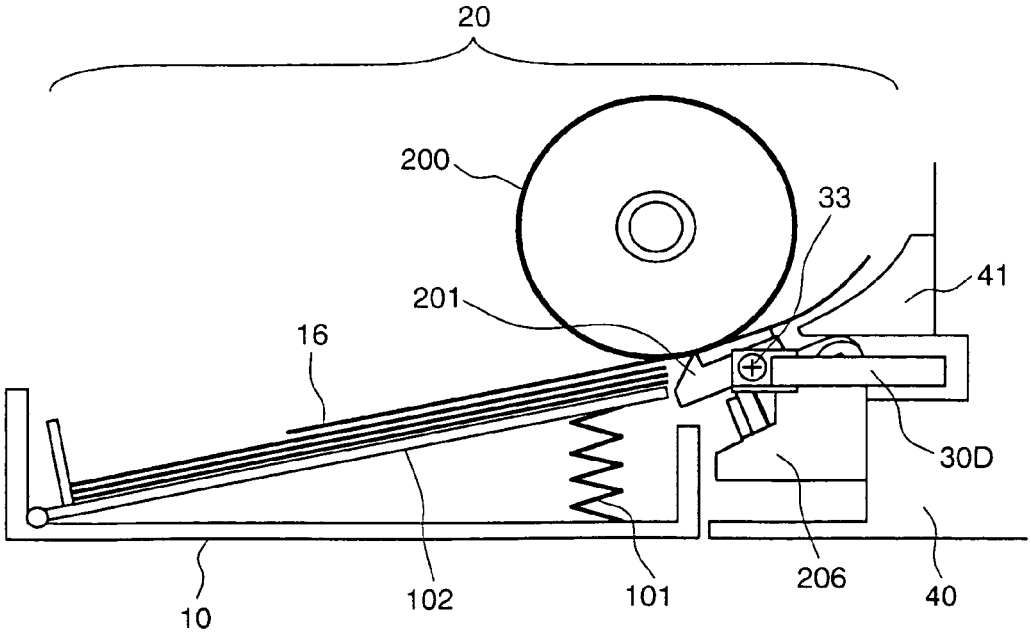
FIG. 11 is a diagrammatic side view representing the configuration of a fourth embodiment of a paper feeder according to the present invention.
Figure 10:
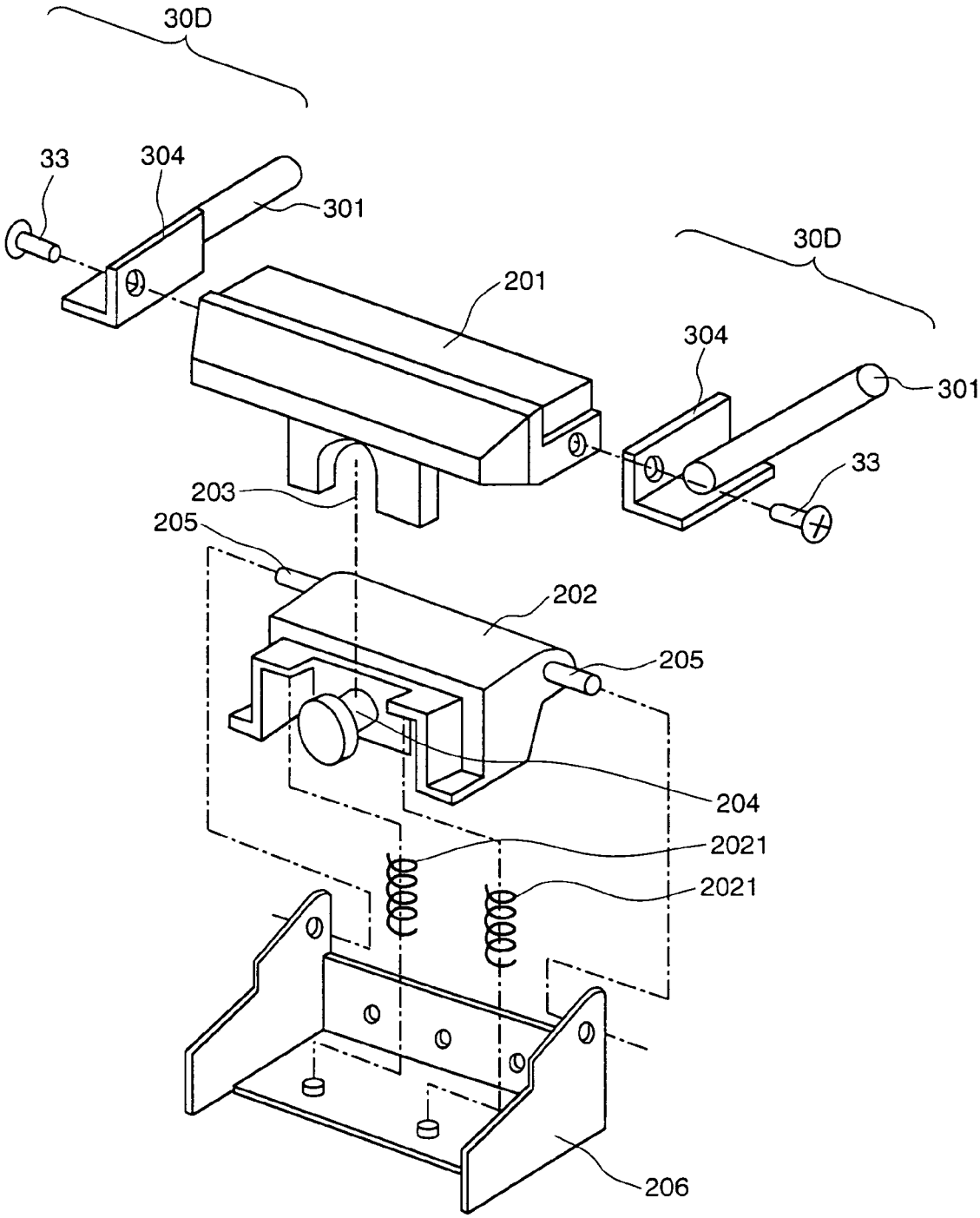
FIG. 10 is a developed perspective view representing the configuration of a fourth embodiment of a paper feeder according to the present invention.
Figure 12A:
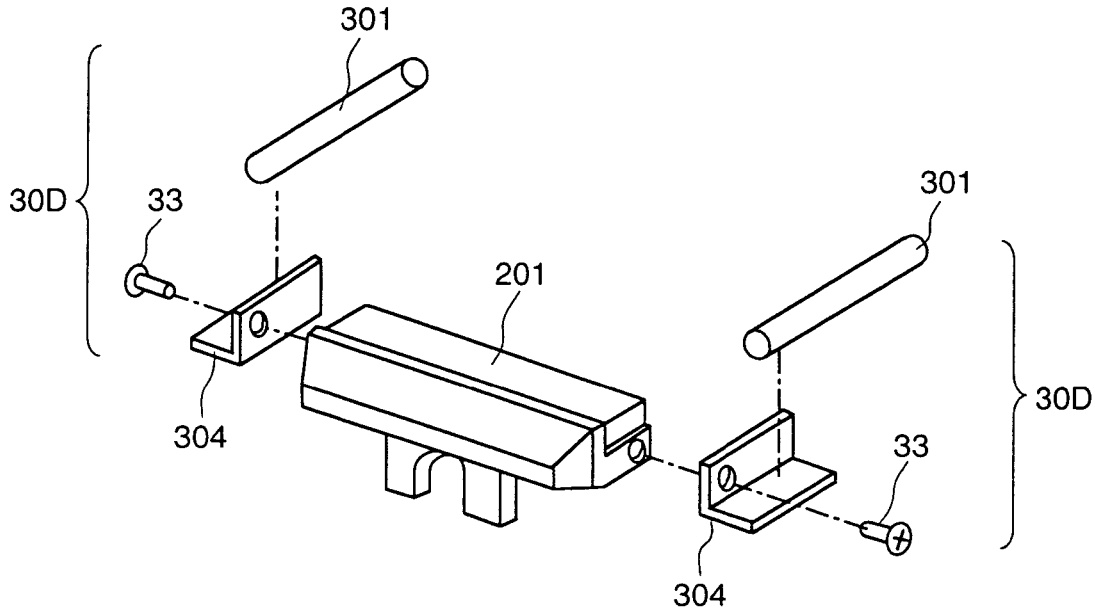
FIGS. 12(*a*) and 12(*b*) show a separation pad and a buffer for use in a fourth embodiment of a paper feeder according to the present invention, wherein FIG. 12(*a*) is a developed perspective view showing the device before assembling and FIG. 12(*b*) a perspective view showing the device after assembling.
Figure 12B:
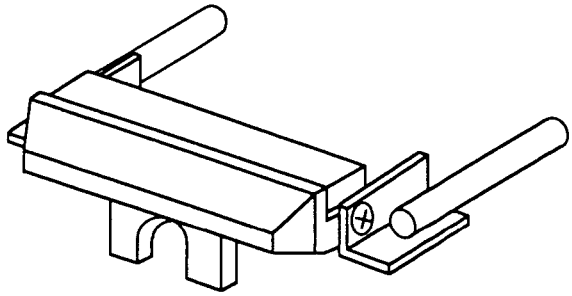

FIG. 10 is a developed perspective view representing the configuration of a fourth embodiment of a paper feeder according to the present invention. FIG. 11 is a diagram representing the configuration of this fourth embodiment of a paper feeder according to the present invention, as viewed from the side of the printer 1. FIG. 12(*a*) is a developed perspective view representing the buffer 30D in the fourth embodiment of a paper feeder according to the present invention.

The difference in this fourth embodiment from the configuration of FIG. 1 is that the viscoelastic body 301 which is provided as part of the buffer is installed in the direction of paper feed, and the fixture 304 is also installed longitudinally in the direction of paper feed. Otherwise, there is no difference from FIG. 1. To put it another way, one end of the viscoelastic body 301 is secured onto the fixture 304, and the other end is extended in the direction of paper feed, wherein the other end is free. Further, a buffer 30D is secured on each end of the separation pad 201 with a screw. As shown in FIG. 1, a portion of the viscoelastic body 301 is fixed on each end of the separation pad 201 through a fixture 304 so as to enter the space surrounded by the paper feed guide 41 and frame 40. To put it another way, the viscoelastic body 301 is provided so as to occupy a space other than that of the feed path of the paper 16. In this way, the paper 16 is not touched even if vibration occurs, and it is fed without being interrupted thereby.

As shown in FIGS. 12(*a*) and 12(*b*), the buffer 30B in the present embodiment consists of a fixture 304 and viscoelastic body 301, as described above. Here the viscoelastic body 301 and fixture 304 are selected in such a way that the buffer 30D will meet the requirement of the primary resonant frequency F and logarithmic decrement δ of the buffers 30D, similar to the case of the first embodiment. The buffer 30D based thereon is mounted on each side of the separation pad 201 in a symmetrical form, whereby the stick-slip condition between the paper 16 and separation pad 201 can be avoided.

The viscoelastic body 301 in the present embodiment is a CR rubber member of cylindrical form, and one end is bonded to the fixture 304, with the other end being free. The fixture 304 engaged with a tapped hole on each side of the separation pad 201. The fixture 304 of the buffer 30D is mounted by a screw 33 on each end of the separation pad 201.

When the paper feed roller 200 rotates and the paper 16 sandwiched by the paper feed roller 200 and separation pad 201 is fed, a stick-slip condition may occur between the paper 16 and separation pad 201, whereby the separation pad 201 is vibrated by the paper 16. The CR rubber member which serves as a viscoelastic body 301 of the buffer 30D and is fixed on the separation pad 201 vibrates so as to dissipate the vibration energy of the separation pad 201. As a result, the vibration of the separation pad 201 is minimized, thereby to reduce any abnormal noise.

The buffers 30A through 30D in the first through fourth embodiments of the present invention each weigh about 2.5 grams. This weight is sufficiently smaller than that of the separation pad 201, which is 20 grams. This does not interrupt the rotation of the separation pad 201. Further, two buffers 30A through 30D are mounted in a symmetrical form with respect to the separation pad 201. Thus, there is no change in the center of gravity of the separation pad 201. Therefore, even if the buffers 30A through 30D are mounted on the separation pad 201, there is no deterioration in the paper feed capacity of the paper feeder 20.

In a further embodiment, only one buffer 30 may be mounted on the separation pad 201 if the buffer 30 does not affect the paper feed capacity of the paper feeder 20.

[Embodiment 5]

Figure 16A:
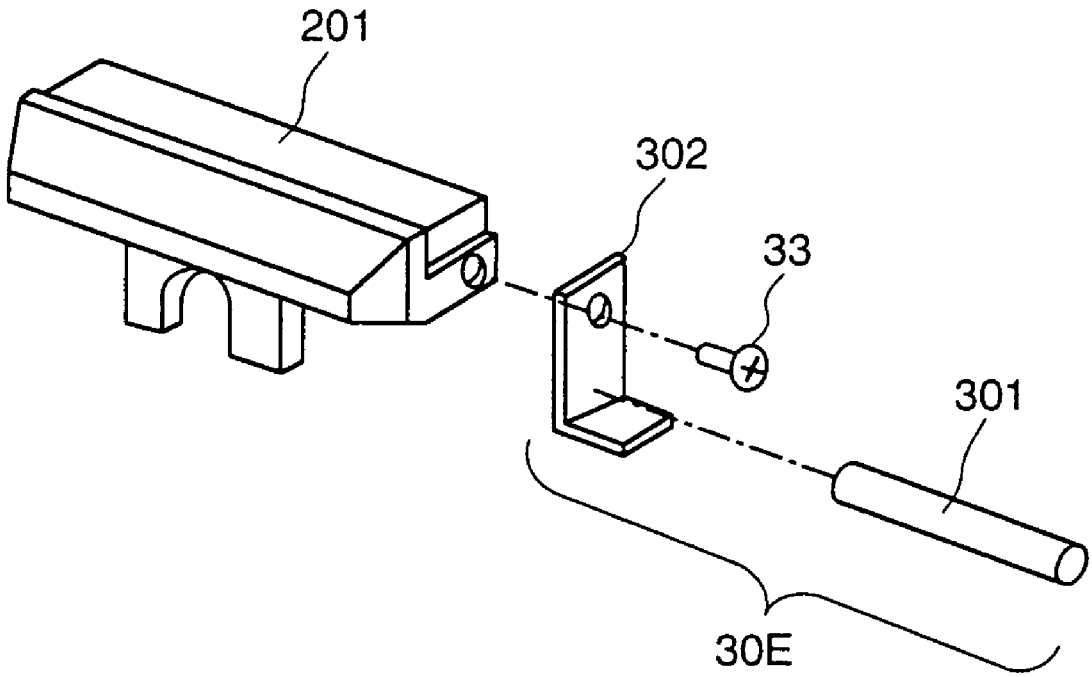
FIGS. 16(*a*) and 16(*b*) show a separation pad and a buffer for use in a fifth embodiment of a paper feeder according to the present invention, wherein FIG. 16(*a*) is a perspective view showing the device before assembling and FIG. 16(*b*) a perspective view showing the device after assembling.
Figure 16B:
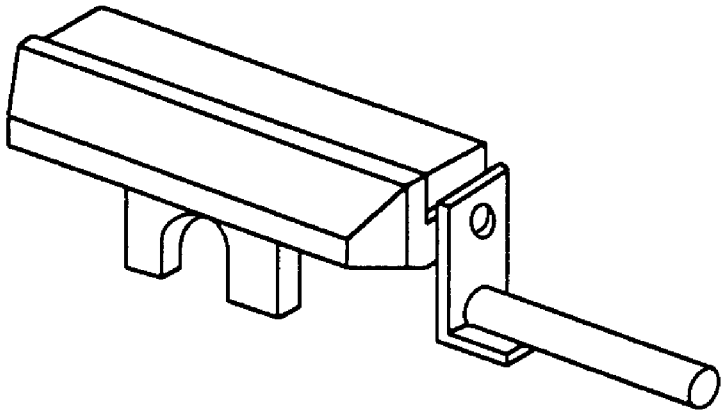

FIGS. 16(*a*) and 16(*b*) show a buffer 30E for use in a fifth embodiment of a paper feeder according to the present invention. The difference from the embodiment shown in FIG. 1 is that this buffer 30E is configured in such a way that a viscoelastic body 301 is mounted on one side alone, whereas the first embodiment is configured in such a way that a buffer 30A with a viscoelastic body 301 is mounted on each side.

Figure 17:
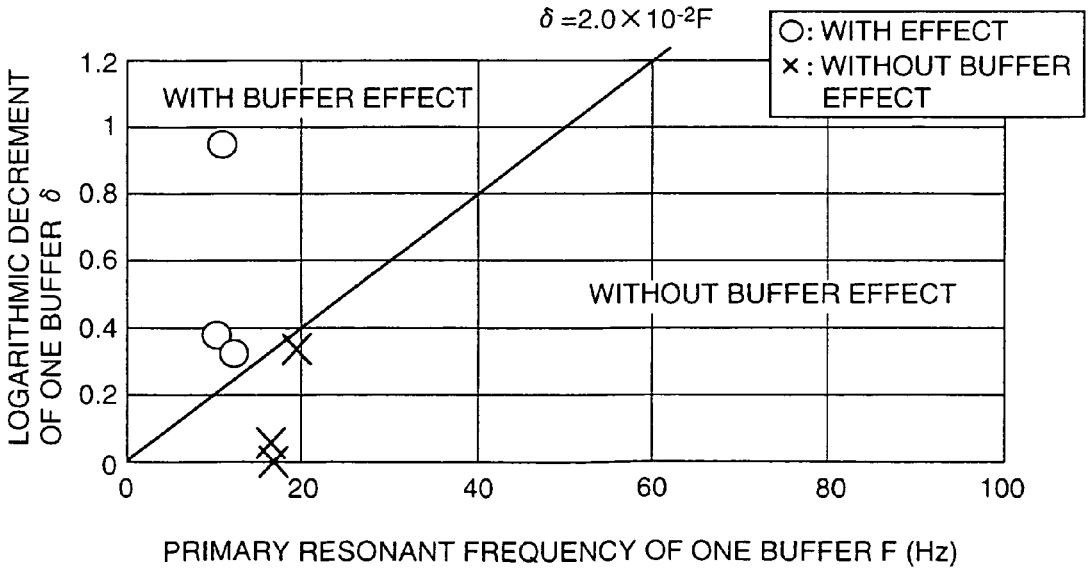
FIG. 17 is a graph showing an example of the relationship between the primary resonant frequency F and logarithmic decrement δ of the buffer 30E, and the effect of preventing abnormal noise when the buffer 30E is mounted on one side of the separation pad 201 in a fifth embodiment of the paper feeder of the present invention.

FIG. 17 shows an example of the relationship between the primary resonant frequency F and logarithmic decrement δ of the buffer 30E, and the effect of preventing abnormal noise when the buffer 30E is mounted on one side of the separation pad 201 in the fifth embodiment. In FIG. 17, a circle ("o") indicates that no abnormal noise has occurred during paper feed, whereas a cross "x" denotes that abnormal noise has occurred during paper feed. As a result, in the paper feeder 20 of the present invention, the viscoelastic body 301 and fixture 302 are selected in such a way that the primary resonant frequency F and logarithmic decrement δ of the buffers 30 meets the relationship $\delta/F \geqq 2.0\times10^{-2}$ (unit: 1 Hz). The buffer 30E based thereon is mounted on one end of the separation pad 201, thereby preventing generation of abnormal noise caused by occurrence of the stick-slip condition between the paper 16 and the separation pad 201.

The viscoelastic body 301 is a cylindrical CR rubber member and the one end is bonded to the fixture 302.

The fixture 302 engages with a tapped hole on one side of the separation pad 201. The fixture 302 of the buffer 30E is secured on the one end of the separation pad 201 by means of a screw 33.

When the paper feed roller 200 rotates and the paper 16 sandwiched by the paper feed roller 200 and separation pad 201 is fed, a stick-slip condition may occur between the paper 16 and separation pad 201, whereby the separation pad 201 is vibrated by the paper 16. In this case, the CR rubber which serves as a viscoelastic body 301 of the buffer 30E and is fixed on the separation pad 201 vibrates to dissipate the vibration energy of the separation pad 201. As a result, the vibration of the separation pad 201 is minimized, thereby to reduce any abnormal noise. Further, it goes without saying that the configuration of the fifth embodiment can be applied to the second through fourth embodiments.

In the aforementioned embodiments, a spring coated with a CR rubber or silicone rubber is used as the material of the viscoelastic body 301, by way of example. The viscoelastic body 301 need not be made of such a material alone; rather, it may be made of EPDM or urethane, for example. The shape is not restricted to a cylindrical form; it can be prismatic or coil-shaped, for example.

Further, the material of the viscoelastic body 301, the method for connection between the fixtures 302, 303 and 304 and the viscoelastic body 301, and combinations thereof are not restricted to the aforementioned description. For example, the viscoelastic body 301 may be fixed to the fixtures 302, 303 and 304 by screws.

The fixtures 302, 303 and 304 need not be L-shaped. The shape of the fixtures 302, 303 and 304 may be modified to ensure that the buffer 30 will not contact a portion other than the separation pad 201. Further, the separation pad 201 and fixtures 302, 303 and 304 may be integrally molded in one piece. Alternatively, the fixtures 302, 303 and 304, and the viscoelastic body 301 may be integrally molded in one piece.

The invention claimed is:

1. A paper feeder comprising:

a paper feed roller for feeding paper;

a separation pad holder for supporting a separation pad rotatably about a shaft in parallel to a direction of paper feed and for applying said separation pad to said paper feed roller; and a holder support for supporting said separation pad holder rotatably about a rotary shaft parallel to a tangential line of said separation pad and paper feed roller;

wherein sheets of paper are fed by separating them one by one and feeding them between said paper feed roller and said separation pad;

characterized in that said separation pad includes one or more vibration buffers provided on the separation pad at an outer right side and one or more vibration buffers provided at an outer left side in a paper feed direction each in the form of a cantilever beam, said vibration buffers being mounted as a pair extending in one direction of the separation pad, wherein one end of a viscoelastic body is secured to said separation pad, and wherein the other end of the viscoelastic body does not contact any portion of the paper feeder or separation pad.

2. The paper feeder described in claim 1, characterized in that a value obtained by dividing a logarithmic decrement of said vibration buffer in a case where a free end is measured by a primary resonant frequency of said vibration buffer in the case where the free end is measured is equal to or greater than $2.0\times10^{-2}$ (1/Hz).

3. The paper feeder described in claim 1, characterized in that said viscoelastic body of said vibration buffer is cylindrical.

4. The paper feeder described in claim 1, characterized in that said viscoelastic body of said vibration buffer is made of rubber.

5. The paper feeder described in claim 1, characterized in that said viscoelastic body of said vibration buffer is formed of a spring or a member having a surface of a spring coated with a viscoelastic material.

6. The paper feeder described in claim 1, characterized in that said viscoelastic body is bonded to a fixture with an adhesive.

7. The paper feeder described in claim 1, characterized in that said vibration buffer consists of said viscoelastic body and a fixture crimping about said viscoelastic body.

8. The paper feeder described in claim 1, characterized in that the paper feeder forms a part of an image forming apparatus.

9. The paper feeder described in claim 1, characterized in that the paper feeder is adapted to be connected to an image forming apparatus so as to feed paper thereto.

* * * * *